US007513267B2

(12) United States Patent
Gendriesch et al.

(10) Patent No.: US 7,513,267 B2
(45) Date of Patent: Apr. 7, 2009

(54) UMBRELLA

(75) Inventors: Jürgen Gendriesch, Düsseldorf (DE); Jürgen Schubert, Düsseldorf (DE); Alexander Prang, Düsseldorf (DE)

(73) Assignee: Structurelab GmbH, Dusseldorf (DE)

( * ) Notice: Subject to any disclaimer, the term of this patent is extended or adjusted under 35 U.S.C. 154(b) by 300 days.

(21) Appl. No.: 10/550,908

(22) PCT Filed: Mar. 23, 2004

(86) PCT No.: PCT/EP2004/003065

§ 371 (c)(1),
(2), (4) Date: Sep. 27, 2005

(87) PCT Pub. No.: WO2004/086898

PCT Pub. Date: Oct. 14, 2004

(65) Prior Publication Data

US 2007/0095374 A1 May 3, 2007

(30) Foreign Application Priority Data

Mar. 31, 2003 (DE) ..... 203 05 166 U
Mar. 31, 2003 (DE) ..... 203 05 168 U
Dec. 23, 2003 (DE) ..... 103 60 864

(51) Int. Cl.
*A45B 25/18* (2006.01)
*A45B 25/00* (2006.01)

(52) U.S. Cl. ..... 135/33.2; 135/31

(58) Field of Classification Search ..... 135/15.1, 135/20.1, 23, 27, 29, 31–32, 156, 98; 343/912–915
See application file for complete search history.

(56) References Cited

U.S. PATENT DOCUMENTS

| | | | | |
|---|---|---|---|---|
| 324,581 | A * | 8/1885 | Nesbitt | 135/25.33 |
| 808,249 | A * | 12/1905 | McGuire | 135/27 |
| 2,114,598 | A * | 4/1938 | Grissel | 135/15.1 |
| 3,252,469 | A * | 5/1966 | Peake | 135/25.31 |
| 5,611,364 | A | 3/1997 | Woods et al. | |
| 6,460,556 | B2 * | 10/2002 | Zheng | 135/125 |

FOREIGN PATENT DOCUMENTS

| | | |
|---|---|---|
| DE | 37 08 921 | 9/1988 |
| DE | 195 41 744 | 5/1997 |
| DE | 101 28 940 | 11/2002 |

* cited by examiner

*Primary Examiner*—David Dunn
*Assistant Examiner*—Danielle Jackson
(74) *Attorney, Agent, or Firm*—Andrew Wilford

(57) ABSTRACT

An umbrella has a shaft anchorable in or on the ground or in the air by an anchor and defining an axis and a canopy movable between an unfolded open position in which it is wavy and a folded position inclined to the axis, made of a preferably nonstretching membrane or fabric, formed of a whole number of polygonal sections with outer corners defining alternating high points and low points, traversed at a center by the shaft, centrally axially slidable along the shaft or centrally fixed on the shaft, and having an outer edge. An array of rods extending radially from and pivoted on the shaft extend in the open unfolded position from the shaft to the corners. These rods are wholly above the canopy and do not pass through the canopy.

17 Claims, 18 Drawing Sheets

UMBRELLA

CROSS REFERENCE TO RELATED APPLICATIONS

This application is the US national phase of PCT application PCT/EP2004/003065, filed 23 Mar. 2004, published 14 Oct. 2004 as WO 2004/086898, and claiming the priority of German patent application 20305166.1 itself filed 31 Mar. 2003 and German patent application 20305168.8 itself filed 31 Mar. 2003, whose entire disclosures are herewith incorporated by reference.

FIELD OF THE INVENTION

The invention relates to an openable and closable umbrella that is used for protection against the weather, e.g. sun and/or rain, and where any rain water falling on it is deflected outward by a canopy (FIG. 1*a*).

BACKGROUND OF THE INVENTION

Umbrellas are known whose canopies are pointed, with the points directed up or down, and wherein the canopies, as so-called funnel umbrellas, are of two-parts and oppositely curved.

Umbrellas are predominantly used to deflect rain water outward. The arms supporting the canopy of such an umbrella are never completely above the canopy, but are wholly or partly underneath the canopy. The arms of these umbrellas are normally held on a shaft and supported by diagonal spreaders. They are often bent when in use.

Less well know are umbrellas that direct rain water inward toward the shaft. Such embodiments have arms above and/or below.

The particular disadvantage here is that the umbrella as a result of its basic shape is quite large because the pivots of the arms lie at different levels and the umbrella cannot be compactly folded together to be short. In addition the elements underneath the canopy have a support function so that the canopy when erected stands well above them and protection from the weather is reduced. The mechanism with guide wheels and cables in the shaft running to a winch is prone to failure and complex. In addition the canopy has a central opening that can be a problem when it rains.

OBJECT OF THE INVENTION

It is an object of the invention to provide an openable and closable umbrella that directs rain water outward, where the canopy is fully exposed on its underside.

SUMMARY OF THE INVENTION

This object is attained in that the arms supporting the canopy are wholly above the canopy and do not project through it (FIG. 1).

With the invention the canopy seen from below is used in a manner not hitherto valued and the bottom view can be used in a novel manner, e.g. to carry printed matter and artwork of every type, in particular advertising and product art.

Umbrellas according to the invention can be of any size.

It is for example possible to produce according to the dependent claims huge umbrellas with a surface area of for example more than 100 $m^2$, cafe-style umbrellas, small umbrellas for personal use, and even rain umbrellas.

According to the invention the canopy has a wavy shape in an elegant light construction and with double opposite curvature so as to have considerable stability with respect to wind so that its service life is also increased (FIG. 2).

The embodiment of FIG. 3 is advantageous in that the canopy has a wavy shape in an elegant light construction and with double opposite curvature so as to have considerable stability with respect to wind so that its service life is increased.

The embodiment of FIG. 4 is advantageous in that the canopy has an upwardly and downwardly folded shape defined by the lines of the lower (previously presented)s and as a result of its support on the lower (previously presented)s and its double opposite curvature in sections it has a high stability with respect to wind.

The embodiment of FIG. 5 is advantageous in that the canopy has an upwardly and downwardly folded shape defined by the upper (previously presented)s and subdivided into sections and has as a result of its mounting on the upper (previously presented)s and its double opposite curvature considerable stability against wind.

The embodiment of FIG. 6 is advantageous in that the canopy has an upwardly and downwardly folded shape with its folds acting dynamically like a windmill and being made of materials without particular static properties.

The embodiment of FIG. 7 is advantageous in that the canopy is conical, practically smooth and simple, and leads dropping rain water uniformly to all sides.

The embodiment of FIG. 8 is advantageous in that the canopy has a wavy shape creased at the lower (previously presented)s, and is simple and stable and can be made of material without particular static properties.

The embodiment of FIG. 9 is advantageous in that the canopy has a wavy shape as a result of the edge treatment without losing attractiveness and with its edge guides and double opposite inflections it has a particularly good stability with respect to wind.

The embodiment of FIG. 10 is advantageous in that the canopy is forces in to a wavy shape and has no points so that it is an extremely elegant shape and in fact has a sculpted look and once again has as a result of its edge treatment and double opposite inflections a particularly good stability with respect to wind.

The embodiment of FIG. 11 is advantageous in that the canopy looks like a windmill and the lightness of its construction is emphasized.

The embodiment of FIG. 12 is advantageous in that the appearance of the canopy can be changed by sliding the canopy center, water being shed better as the canopy center is raised and fixing of the canopy center increasing stability with respect to wind.

The embodiment of FIG. 13 is advantageous in that the canopy assumes a natural shape, can be sealed around the shaft, and fixing of the canopy center increases stability with respect to wind.

The embodiment of FIG. 14 is advantageous in that the canopy is more elegant because of its loose mount on the umbrella axis, so that it freely assumes a natural shape, and no expensive mounting hardware is needed at the center.

The embodiment of FIG. 15 is advantageous in that the canopy with no shaft going through it is very elegant and its center is available for printing advertising and in addition the center is particularly water tight and no special reinforcements are needed in the center.

The embodiment of FIG. 16 is advantageous in that the canopy is quite striking, in particular dimensionally stable and statically reinforced by the sewn-in straps or cables.

The embodiment of FIG. 17 is advantageous in that the canopy is both elegant and striking, dimensionally stable, and statically reinforced by the sewn-in straps and cables.

The embodiment of FIG. 18 is advantageous in that the canopy is particularly elegant and does not need additional straps or cables.

The embodiment of FIG. 19 is advantageous in that because of the shaped edge the umbrella is more elegant and the canopy is additionally tensioned at its edge.

The embodiment of FIG. 20 is advantageous in that the separation of the functions of the upper and lower (previously presented)s has the interesting result that there are additional degrees of freedom and possibilities of tensioning and with high lower (previously presented)s can have strongly pulled down canopy corners.

The embodiment of FIG. 21 is advantageous in that the umbrella is lighter because the tension and pressure forces are separated, the (previously presented)s pulled upward by cables have great strength resisting gravity and wind and can be tensioned by the cables.

The embodiment of FIG. 22 is advantageous in that the forces are contained in that the ends of the diagonal spreaders bear with some elasticity on the upwardly held (previously presented)s so that the canopy is well tensioned and held by the spreaders.

The embodiment of FIG. 23 is advantageous in that the use of the static properties of the canopy has an elegant effect, the lower (previously presented)s held up by the canopy provide some elasticity and the static properties tension the canopy at the lower (previously presented)s and reduce the number of parts.

The embodiment of FIG. 24 is advantageous in that separation of the pushing and pulling forces makes the umbrella lighter, the (previously presented)s engaged underneath by the cables can be pushed with considerable vertical strength to resist wind pressure and suction and prestress the system with the cables.

The embodiment of FIG. 25 is advantageous in that containing the force makes the umbrella more compact, provides some elasticity of the arms where they are engaged by the diagonal spreaders, provides excellent tensioning of the canopy, and prestresses with the spreaders.

The embodiment of FIG. 26 is advantageous in that the use of the static properties of the canopy has an elegant effect, bracing of the spreaders underneath the arms provides some elasticity that prestresses the static properties of the canopy, and can be made with fewer parts.

The embodiment of FIG. 27 is advantageous in that as a result of dropping the pivotal connection and thereby lowering the arms it is particularly easy to open while raising the pivotal connections requires little room for closing, so that for example there is ample room underneath for a table and no particular means need be provided to tension the canopy since all of the arms are pushed upward with the diagonal spreaders by the cables.

The embodiment of FIG. 28 is advantageous in that the use of the lower arms without cables or diagonals is more elegant, so that a lowering of the pivotal connection and the thus reduced vertical movement of the arms makes opening the umbrella easier and as a result of raising the pivotal connection less room is needed for closing it so that for example there is ample room underneath for a table and the existing tension uses the canopy so that no cables or diagonal spreaders for the lower arms are needed.

The embodiment of FIG. 29 is advantageous in that use of the push-type diagonal spreaders makes the mechanism short, since above the connection of the arms no shaft is necessary and no particular tensioning devices need be provided for the canopy, since all the arms are raised by the cables or diagonal spreaders.

The embodiment of FIG. 30 is advantageous in that with no diagonal spreaders or cables engaging the lower arm the umbrella is more elegant, and use of diagonal pushers makes the structure short since above the connection of the arms no shaft need be provided and the existing tension uses the canopy so that no cables or diagonal spreaders are needed for the lower arms.

The embodiment of FIG. 31 is advantageous in that no expensive mechanism for moving the umbrella tip or runner sleeve is needed for the umbrella since use of the pushing diagonal spreaders makes the structure short and the shaft need not extend above the connection and no particular tensioning means are needed for the canopy since all the arms are raised by the cables or diagonal spreaders.

The embodiment of FIG. 32 is advantageous in that, as a result of there being no cables or diagonals for the lower arms, the umbrella is more elegant, no expensive mechanism is needed to move the umbrella tip or sleeve, the diagonal spreaders fit in a small space, and no shaft is needed above the joint so that no cables or diagonal spreaders are needed for the lower arms.

The embodiment of FIG. 33 is advantageous in that the umbrella with upper arms and lower arms can be folded completely together.

The embodiment of FIG. 34 is advantageous in that when folded up the umbrella has no big folds and thus rain water runs better out.

The embodiment of FIG. 35 is advantageous in that the umbrellas fit elegantly together in a row, dropping rain water is largely moved to the outside, they can be put together into other groupings or used alone, when linked up they can be mechanically interconnected for greater wind resistance, and a larger integrated rain-protected surface is created since with a hanging system the area underneath the canopies is free of masts.

The embodiment of FIG. 36 is advantageous in that the umbrellas form an elegant system when grouped together, dropping rain water is largely directed outward, the umbrellas can be set out individually or used in other formations and when grouped together can be mechanically interconnected to form a larger more wind-resistant rain-protected space which when hung is even free of masts.

The embodiment of FIG. 37 is advantageous in that the umbrella can be futuristically illuminated, effectively used as a light sculpture or lamp, and printing on the canopy with advertising can be displayed dramatically.

All the arms of the umbrella normally extend radially of the umbrella axis. This is advantageous in that the forces effective on the arms are transmitted directly to the umbrella axis and the arms pivoted on the axis can easily be folded together.

In the open position all or some of the arms extend downward, their outer ends and the corresponding corners of the canopy of each arm lying below their inner ends at the canopy center. This is advantageous in that it deflects falling rain water outward.

In particular in embodiments with conical canopies the longitudinal axes of the arms intersect the umbrella axis at a common point. Their outer end are in this variant are coplanar. Preferably in this embodiment the structure is very compact and symmetrically resists applied forces.

The arms of the umbrella can be straight or bent. According to embodiment, the arms are either compressed or bent. The arms can be particularly resistant to bending or quite elastic.

By varying the properties of the arms it is possible to make the static system accord optimally with the desire appearance of the umbrella embodiment.

The umbrellas can have any desired geometric shape (FIG. 38), in particular shapes are possible where the canopy corners are distributed seen in top view uniformly around a circle or ellipse so that canopy sections are each defined between two canopy corners and the canopy axis and are of the same area. This "circular" umbrella is preferably in that the umbrella has no particular orientation and as a result of being rotation-symmetrical it is most efficiently dimensioned. The "elliptical" umbrella is advantageous in that the umbrella has an oriented shape and as a result of this elongation is particularly dynamic and elegant. Further shapes where 4+4n canopy corners define a quadrilateral or rhombus and 4+2n canopy corners define a rectangle. These shapes are preferable in that several umbrellas of similar shape can easily be assembled together and form a stronger larger structure. The particular shapes also include "circular" umbrellas with off-center canopy axes or "semicircular" umbrellas. A noncentered canopy axis is advantageous in a permanently mounted umbrella that can be oriented best for sun protection. The "semicircular" umbrella is advantageous as it can be set against a wall.

The umbrellas are preferably opened and closed by a winch shaft that is rotated by a crank via bevel gears. In a simplified system it is possible to open and close the umbrellas with the use of cords. The opening and closing can be mechanical, hydraulic, or assisted by an electric motor or pneumatic lifter. The mechanical system is preferably as the umbrella can be opened and closed by pushing a button and in combination with a wind monitor it can close automatically and thus be smaller.

The opening mechanism can also be assisted by an end mount. This end mount ensures that when closed there is a minimal angle between the arms and the cables or spreaders in order to be able to exert some force on the arms to start the opening movement. According to the opening mechanism the spreaders or arms or the cables that open the arms are connected to this end mount (FIG. 40).

The tensioned canopy can also be precisely prestressed by tensioning elements. Such tensioning elements, that are fitted between the canopy points and the ends of the arms, permit the canopy to be connected to the ends of the arms when they are swung up into the open position.

The shaft that forms part of the mast and on which all of the parts directly or indirectly necessary for tensioning the canopy is mounted on an anchor or a hanger. The anchor is preferably formed as a mast and set in a movable stand or a stationary anchor hole. The hanger extends above the canopy and holds the umbrella from above. This is known from hanging umbrellas can be anchored by movable stands on the floor or in a fixed anchor on the floor or wall. It is preferable to provide a link between the rod and the anchor, so that the rod and the canopy can be tipped according to the position of the sun.

DESCRIPTION OF THE FIGURES

Embodiments of the invention are described with reference to the drawing in which:

FIG. 27 is an embodiment of the umbrella opened by moving the arms downward along the axis in isometric view in different positions, namely (a), (b), and (c) with all the arms held up by cables, (d), (e), and (f) with all the arms held up by diagonal spreaders, (g), (h), and (i) with all the arms held up by diagonal spreaders;

FIG. 28 is an embodiment of the umbrella opened by moving the arms downward along the axis in isometric view in different positions, namely (a), (b), and (c) with all the upper arms held up by cables, and (d), (e), and (f) with all the upper arms held up by diagonal spreaders;

FIG. 29 is an embodiment of the umbrella opened by moving the cables or diagonal spreaders upward along the axis in isometric view in different positions, namely (a), (b), and (c) with all the arms held up by diagonal spreaders, (d), (e), and (f) with all the arms held up by cables, (g), (h), and (i) with all the arms held up by diagonal spreaders;

FIG. 30 is an embodiment of the umbrella opened by moving cables or diagonal spreaders upward along the axis in isometric view in different positions, namely (a), (b), and (c) with all the upper arms held up by cables and all the lower arms held up by tension in the canopy;

FIG. 31 is an embodiment of the umbrella opened by shortening all the cables in isometric view in different positions, namely (a), (b), and (c) with all the arms held up by cables;

FIG. 32 is an embodiment of the umbrella opened by shortening all the cables in isometric view in different positions, namely (a), (b), and (c) with all the upper arms held up by cables;

FIG. 33 is an embodiment of the umbrella showing the length of the diagonal spreaders and where they engage the upper and lower arms (a) isometrically (b) in section;

FIG. 34 is an embodiment of the umbrella in section with all the arms secured at the canopy axis to a runner sleeve;

SPECIFIC DESCRIPTION

Figure 1:
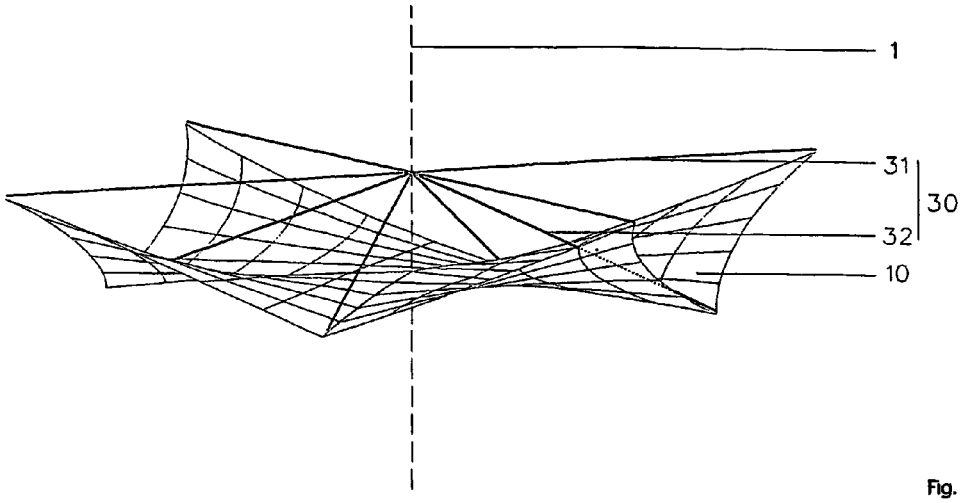
FIG. 1 is an isometric view of an umbrella with arms (30) wholly above the canopy (10)
Figure 2A:
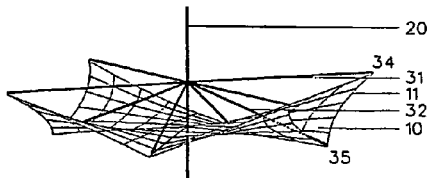
FIG. 2 is a wavy embodiment of an umbrella with a shaft (20) and shown (a) isometrically at an angle from in front and (b) isometrically at an angle from above

FIG. 1 shows in isometric view the basic idea of the invention. A number of shaped canopies 10 are held by arms 30 wholly above the canopy, here there are upper arms 31 and lower arms 32.

Figure 3A:
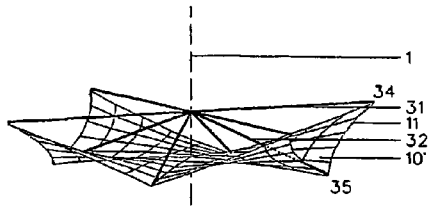
FIG. 3 is a wavy embodiment of the umbrella shown (a) isometrically at an angle from in front and (b) isometrically at an angle from above.
Figure 2B:
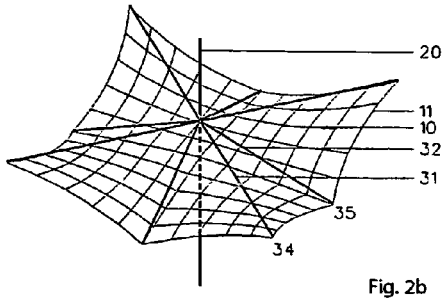
Figure 3B:
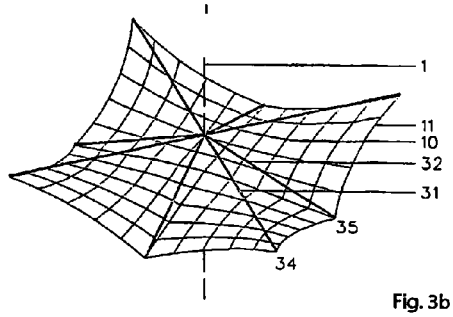
Figure 1A:
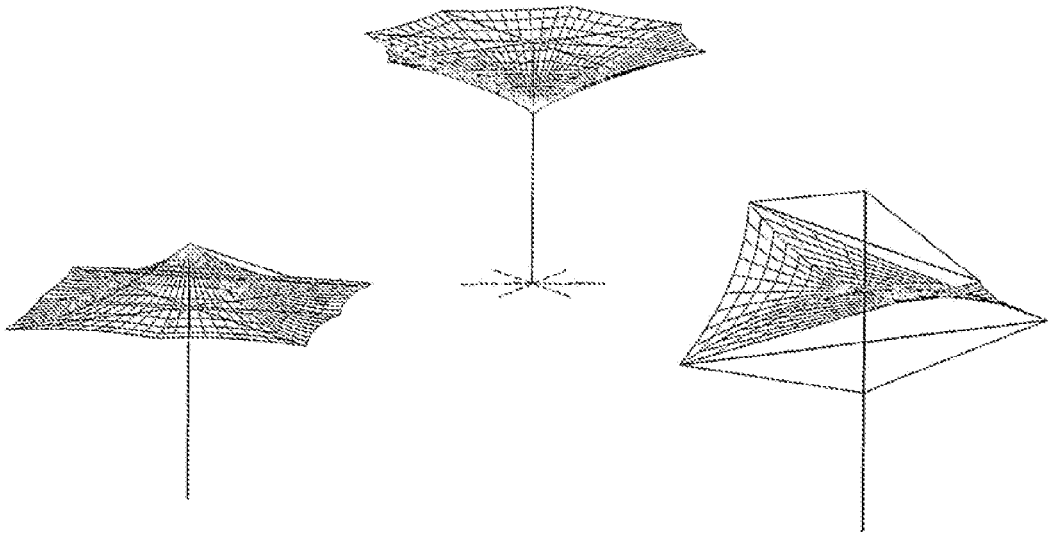
Fig. 1a Prior Art
FIG. 1*a* illustrates the state of the art.

FIG. 3 shows in two isometric views a wavy embodiment of the umbrella or its canopy 10. It is clear that the canopy 10 is tensioned at high points 34 and low points 35.

Figure 4A:
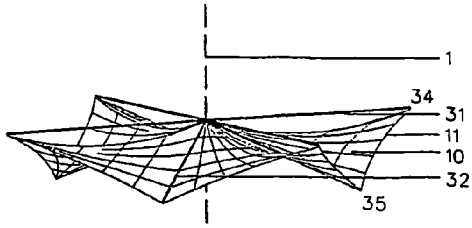
FIG. 4 is a differently folded and shaped embodiment of the umbrella (a) isometrically at an angle from in front and (b) isometrically an angle from above.
Figure 4B:
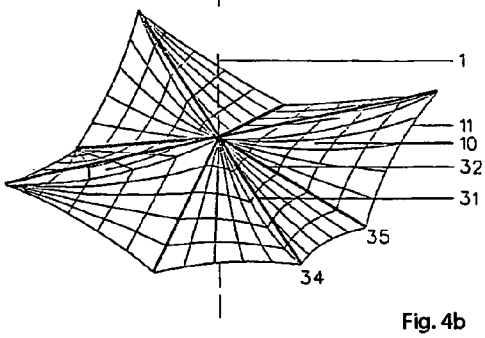

FIG. 4 shows in two isometric views alternately upwardly forced and downwardly folded embodiments of the umbrella or its canopy 10. It is clear that the canopy 10 is alternately drawn up to high points 34 and down by lower arms 32 to low points. The canopy 10 is creased along the lower arms 32.

Figure 5A:
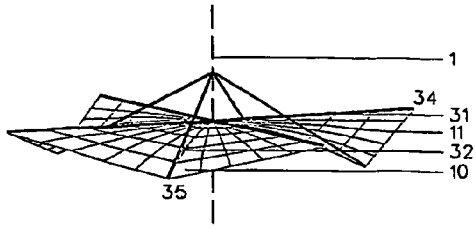
FIG. 5 is a differently folded and shaped embodiment of the umbrella (a) isometrically at an angle from in front and (b) isometrically an angle from above.
Figure 5B:
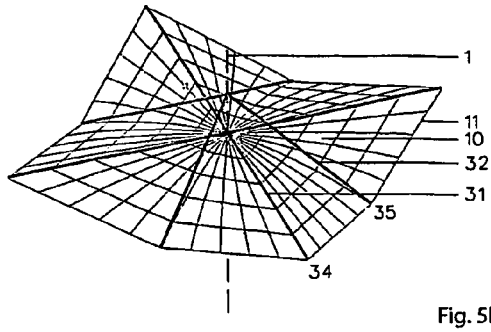

FIG. 5 shows in two isometric views alternately upwardly and downwardly folded embodiments of the umbrella or its canopy 10. It is clear that the canopy 10 is drawn down into low points 34 and upward by upper arms 31. The canopy 10 forms folds along the upper arms 31.

Figure 6A:
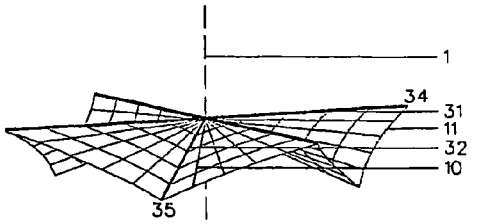
FIG. 6 is a differently folded and shaped embodiment of the umbrella (a) isometrically at an angle from in front and (b) isometrically an angle from above.
Figure 6B:
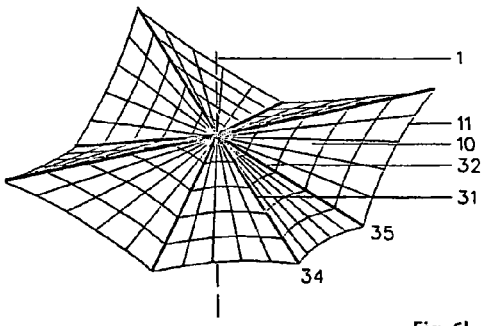

FIG. 6 shows in two isometric views alternately upwardly and downwardly folded embodiments of the umbrella or its canopy 10. It is clear that the canopy 10 is alternately pushed up by upper arms 31 and downward by lower arms 32. The canopy 10 forms creases along the upper arms 31 and the lower arms 32.

Figure 7A:
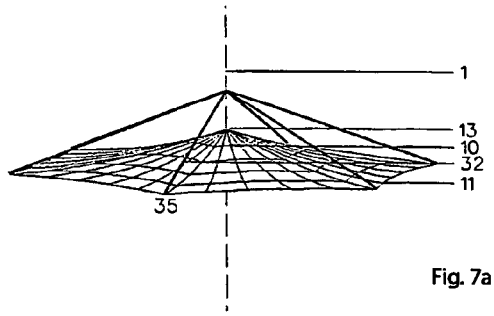
FIG. 7 is a conical embodiment of the invention (a) isometrically at an angle from in front and (b) isometrically at an angle from above.
Figure 7B:
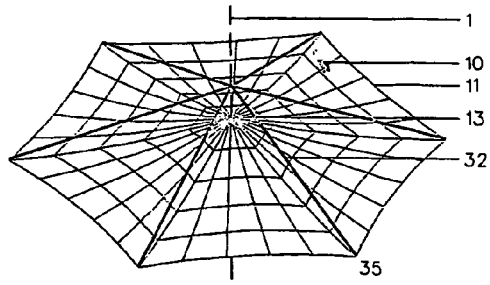

FIG. 7 shows in two isometric views a conical embodiment of the umbrella or its canopy 10. It is clear that the canopy 10 is drawn upward at the canopy center 13 along the umbrella axis 10 and downward by low points 35.

Figure 8A:
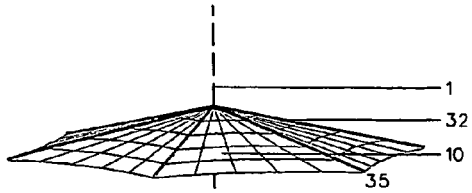
FIG. 8 is a conical embodiment folded along the lower arms of the umbrella (a) isometrically at an angle from in front and (b) isometrically from above.
Figure 8B:
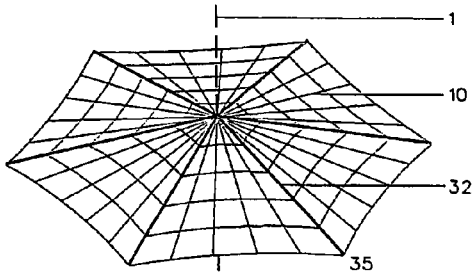
Figure 9A:
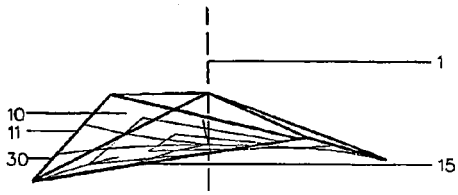
FIG. 9 is a wavy embodiment of the umbrella (a) with straight canopy edge segments at an angle isometrically from in front, (b) with straight canopy edge segments isometrically at an angle from above, (c) with a curved canopy edge isometrically at an angle from in front, and (d) with a curved canopy edge isometrically at an angle from above.
Figure 9C:
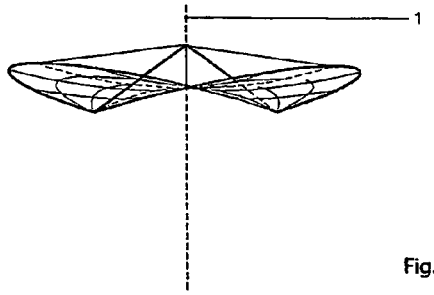
Figure 9B:
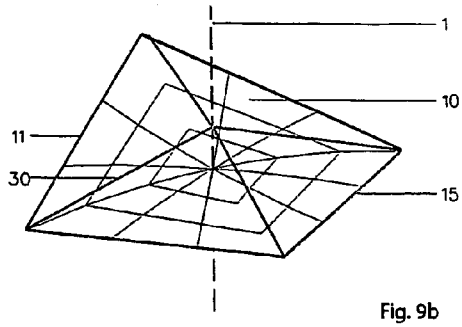
Figure 9D:
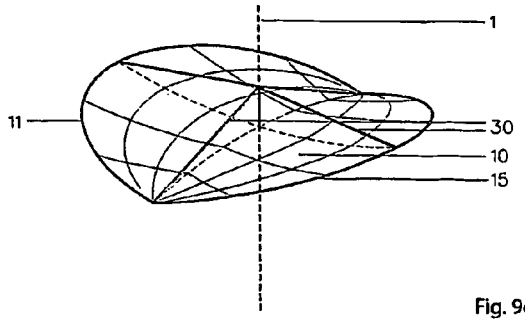

FIG. 8 shows in two isometric views a conical embodiment of the umbrella or its canopy 10 creased along the lower arms. It is clear that the canopy 10 is spanned over lower arms 32. The canopy 10 has creases along the lower arms 32.

FIG. 9 shows in two isometric views two further wavy shaped embodiments of the umbrella or its canopy 10. It is clear that the canopy 10 is tensioned over oppositely angled edge rods 15. The edge rods 15 can be straight or arcuate. The arms 30 do not directly tension the canopy 10.

Figure 10A:
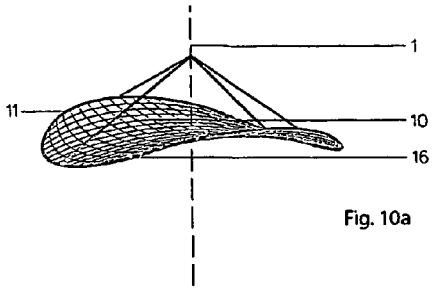
FIG. 10 is a wavy embodiment of the umbrella without canopy corners, (a) with a canopy-edge bow isometrically at an angle from in front, and (b) with a canopy-edge bow isometrically at an angle from above.
Figure 10B:
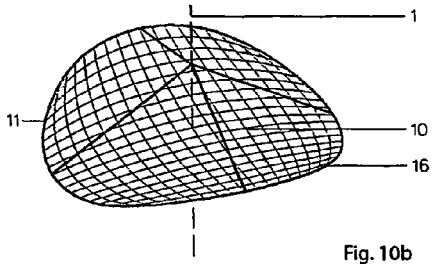
Figure 11A:
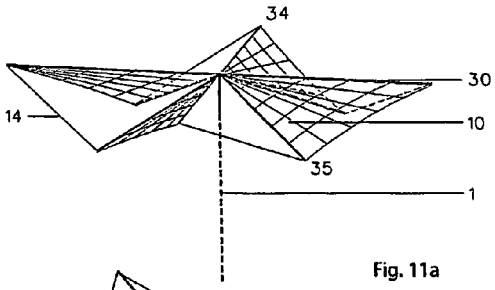
FIG. 11 is an embodiment of the umbrella showing the canopy (a) isometrically at an angle from in front, (b) isometrically from above, (c) isometrically at an angle from in front and (d) isometrically from above.
Figure 11C:
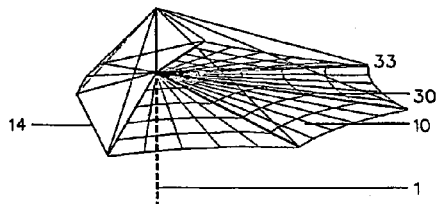
Figure 11B:
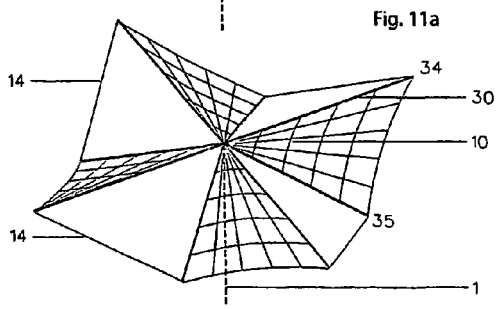
Figure 11D:
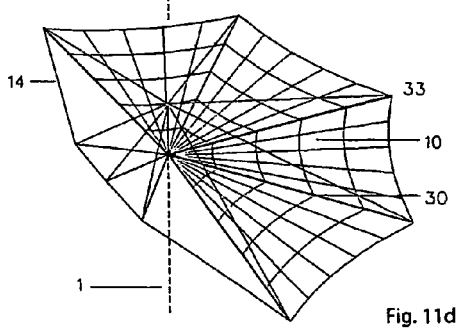

FIG. 10 shows in two isometric views a wavy embodiment of the umbrella or its canopy 10. It is clear that the canopy 10 is spanned over a circularly closed, elastic, and upwardly and downwardly shaped edge bow 16 and has no corners. The arms 30 do not directly tension the canopy 10.

FIG. 11 shows in two isometric views embodiments of an umbrella or its canopy 10 subdivided into sections. It is clear that the canopy 10 in one embodiment is shaped like a windmill. Open and closed sections alternate. In the other embodiments there are several adjacent open sections. The remainder of the canopy 10 is spanned over cables 14 at the edge of the open sections.

Figure 12:
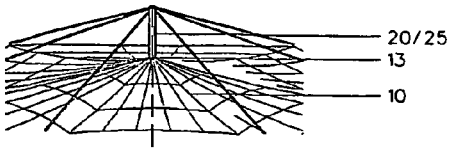
FIG. 12 is an embodiment of the umbrella where the canopy shape is determined by how it is secured at the umbrella axis.

FIG. 12 shows in an isometric view an embodiment of the umbrella or its center 13. It is clear that the canopy center 13 is fixed on the axis 1 so as to influence its shape. In the illustrated case the canopy is drawn upward along the umbrella axis 1.

Figure 13:
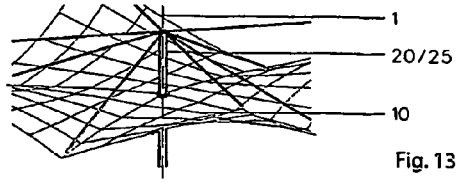
FIG. 13 is an embodiment of the invention where the canopy is secured at the umbrella axis but not so as to influence its shape.

FIG. 13 shows in isometric view an embodiment of the umbrella or its canopy center 13. It is clear that the canopy center 13 is secured at the umbrella axis 1, but the shape of the canopy 10 is not influenced. The canopy center 13 lies at the natural rest point of the canopy 10.

Figure 14:
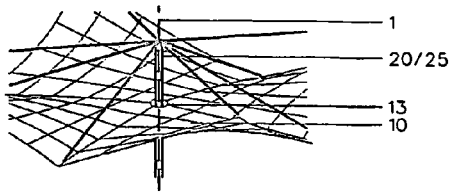
FIG. 14 is an embodiment of the invention where the canopy is not secured at the axis but spacedly surround it.

FIG. 14 shows in isometric view an embodiment of the umbrella or its canopy 10. It is clear that the canopy is cut out at the canopy center 13 and spacedly surrounds the umbrella axis 1. The canopy center 13 lies at the natural rest point of the canopy 10.

Figure 15:
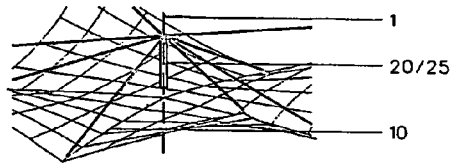
FIG. 15 is an embodiment of the umbrella where the canopy is not necessarily cut out at the axis.

FIG. 15 shows in isometric view an embodiment of the umbrella or its canopy 10. It is clear that the canopy is not necessarily cut out at the canopy center 13 since the shaft 20 ends above the canopy 10 and is held from above. The canopy center 13 lies at the natural rest point of the canopy 10.

Figure 16A:
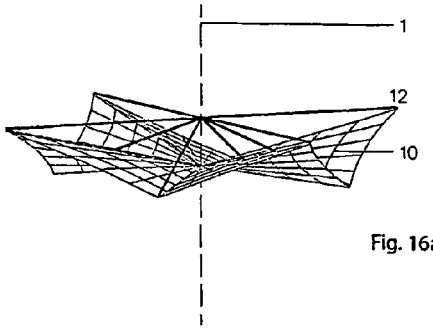
FIG. 16 is an embodiment of the umbrella where the canopy is folded in straight lines along sewn-in cables or straps (a) isometrically at an angle from in front and (b) isometrically from above.
Figure 16B:
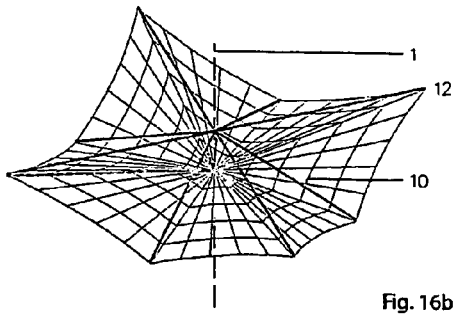

FIG. 16 shows in two isometric views embodiments of the umbrella or its canopy 10. It is clear that the canopy 10 has fold lines extending straight between the canopy corners 12 and the canopy center 13. This is ensured by highly prestressed sewn-in straps or cables.

Figure 17A:
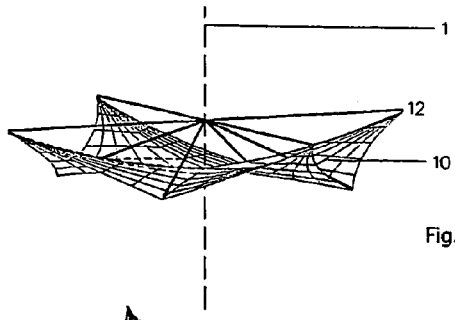
FIG. 17 is an embodiment of the umbrella where the canopy is folded in arcs along sewn-in cables or straps (a) isometrically at an angle from in front and (b) isometrically from above.
Figure 17B:
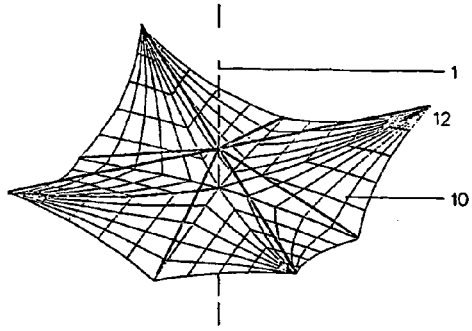

FIG. 17 shows in two isometric views embodiments of the umbrella or its canopy 10. It is clear that the canopy 10 has fold lines extending in arcs between the canopy corners 12 and the canopy center 13. This is ensured by lightly tensioned sewn-in straps or cables.

Figure 18A:
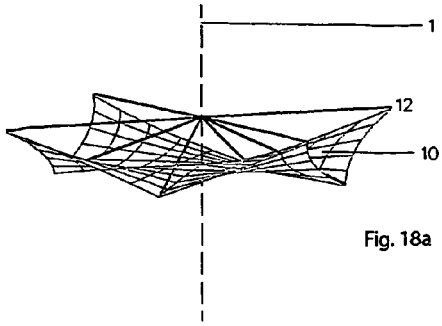
FIG. 18 is an embodiment of the umbrella where the canopy has a free-form shape (a) isometrically at an angle from in front and (b) isometrically from above.
Figure 18B:
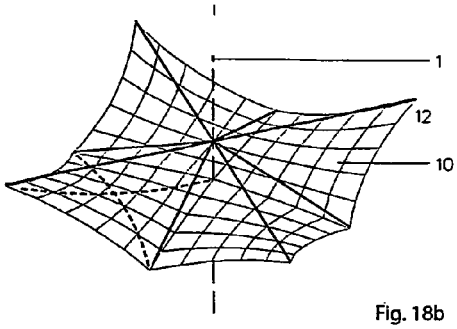

FIG. 18 shows in two isometric views an embodiment of the umbrella or its canopy 10. It is clear that the canopy 10 is deformed into a wavy shape has no folds extend straight between the canopy corners 12 and the canopy center 13. There are neither straps nor cables sewn into the canopy.

Figure 19:
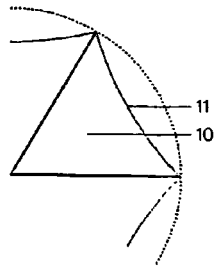
FIG. 19 is an embodiment of the umbrella showing the shaped canopy edge.

FIG. 19 shows a top view of an embodiment of the umbrella or its canopy 10. The canopy edge 11 joining two corners 12 is shaped.

Figure 20:
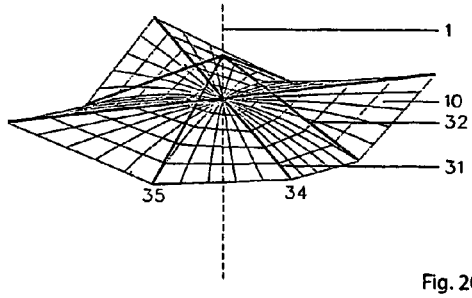
FIG. 20 is an embodiment of the umbrella in isometric view with upper and lower arms attached at different levels at the umbrella axis.

FIG. 20 shows in isometric view an embodiment of the umbrella or its arms 30. It is clear that upper arms 31 and lower arms 32 meet the umbrella axis 1 at different levels. The upper arms 30 extend steeply above the canopy 10 and reach the low points 35 without touching the canopy 10.

Figure 21A:
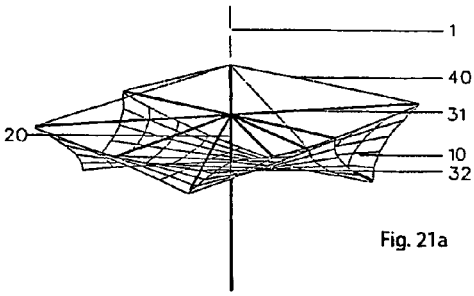
FIG. 21 is an embodiment of the umbrella where most or all of the arms are held up by cables, (a) isometrically with a wavy umbrella (b) isometrically with a creased conical umbrella.
Figure 21B:
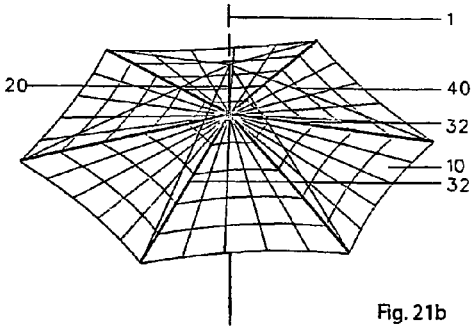

FIG. 21 shows in two isometric views an embodiment of the umbrella or its arms 30. It is clear that in the first isometric view many but not all of the arms, in this example the upper arms 31, are held up by cables. In the second isometric view all the arms of the umbrella, in the illustrated example the lower arms 32 are held up by cables.

Figure 22A:
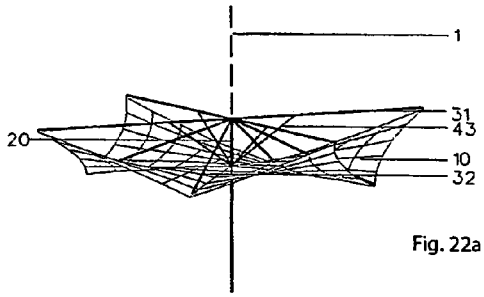
FIG. 22 is an embodiment of the umbrella where most or all of the arms are held up by spreaders (a) isometrically with a wavy umbrella (b) isometrically with a creased conical umbrella.
Figure 22B:
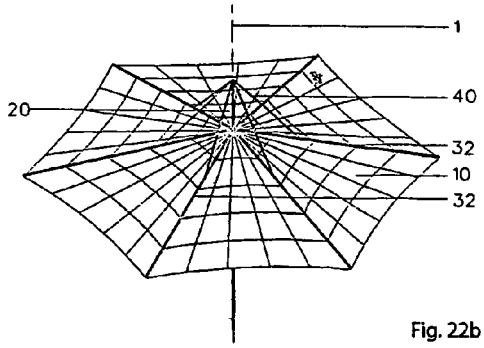

FIG. 22 shows in two isometric views an embodiment of the umbrella or its arms 30. It is clear that in the first isometric view many but not all of the arms, in this example the upper arms 31 are held up by diagonal spreaders. In the second isometric view all the arms of the umbrella, in the illustrated example the lower arms 32 are held up by diagonal spreaders.

Figure 23:
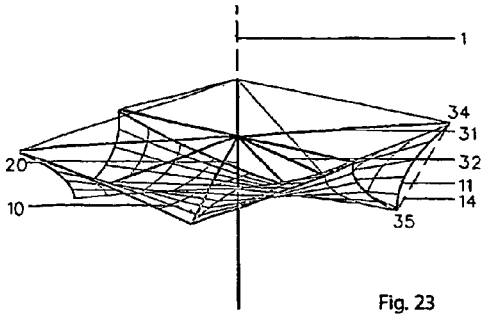
FIG. 23 is an embodiment of the umbrella in isometric view where most or all of the lower arms are held up by the canopy.

FIG. 23 shows in an isometric view an embodiment of the umbrella or its arms 30. It is clear that all the lower arms are held up by the static properties of the canopy 10. The canopy 10 itself is held up in this example by cables.

Figure 24:
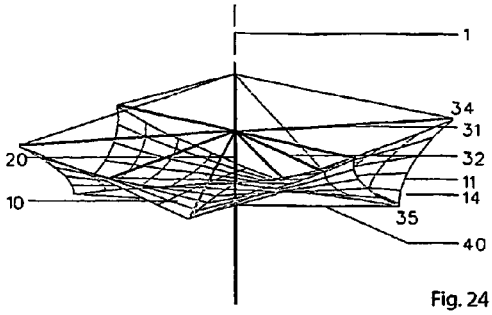
FIG. 24 is an embodiment of the umbrella in isometric view where most or all of the arms are pulled down by cables.

FIG. 24 shows in an isometric view an embodiment of the umbrella or its arms 30. It is clear that many lower arms 32 are tensioned downward by cables.

Figure 25:
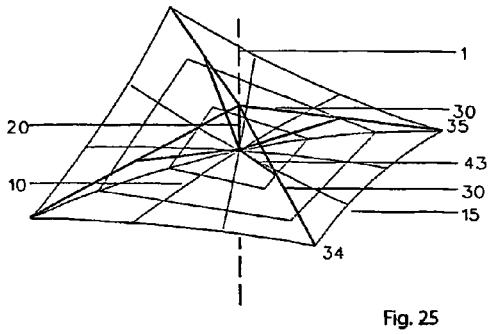
FIG. 25 is an embodiment of the umbrella in isometric view where most or all of the arms are held down by spreaders.

FIG. 25 shows in an isometric view an embodiment of the umbrella or its arms 30. It is clear that most of the arms 30 are pushed downward by diagonal spreaders.

Figure 26:
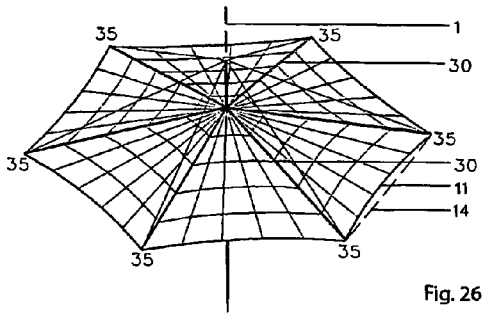
FIG. 26 is an embodiment of the umbrella in isometric view where most or all of the arms are pulled down by the canopy.
Figure 27A:
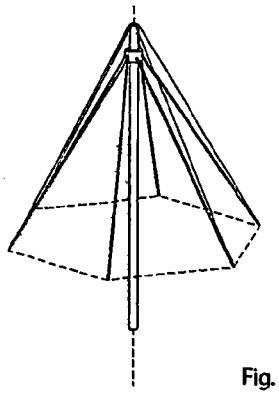
FIGS. 27 to 34 show preferred embodiments of the opening and closing mechanism.
Figure 27B:
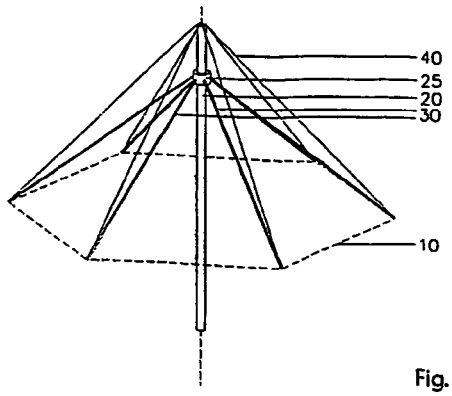
Figure 27C:
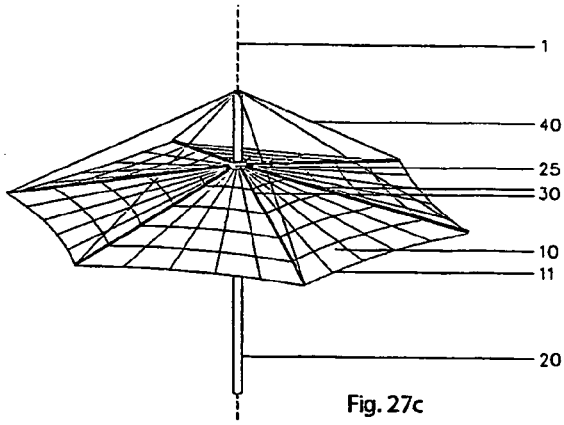
Figure 27D:
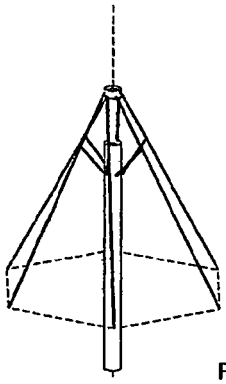
Figure 27E:
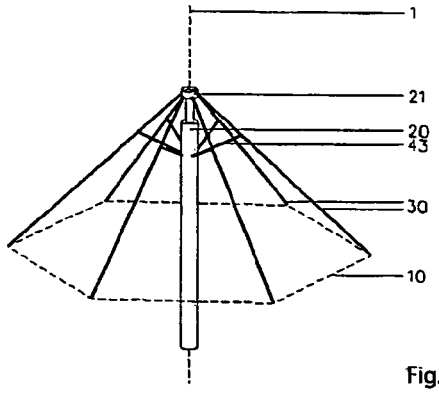
Figure 27F:
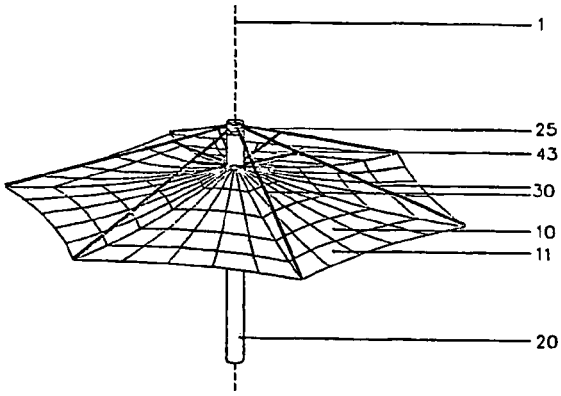
Figure 27G:
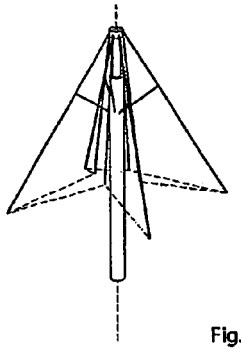
Figure 27H:
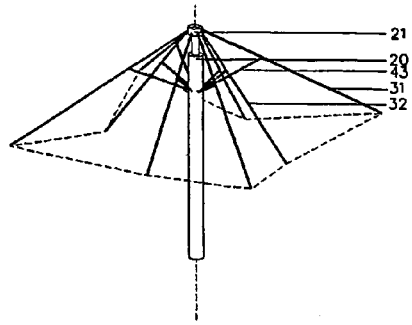
Figure 27I:
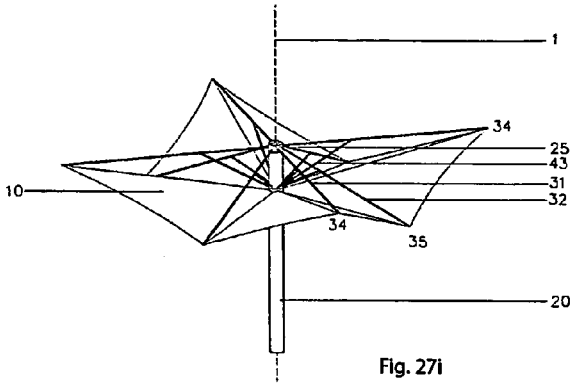
Figure 28A:
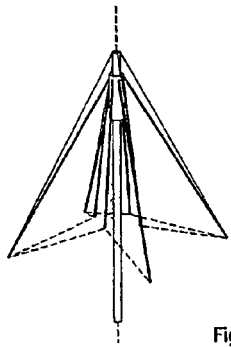
Figure 28B:
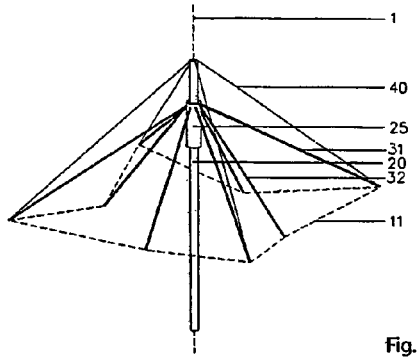
Figure 28C:
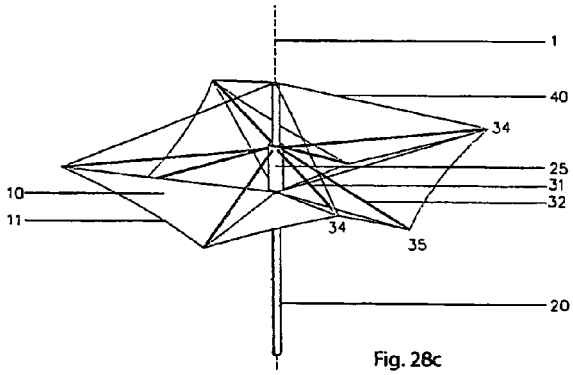
Figure 28D:
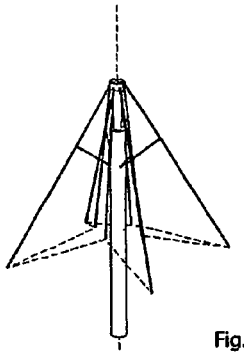
Figure 28E:
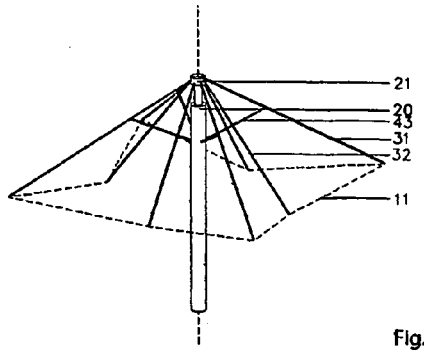
Figure 28F:
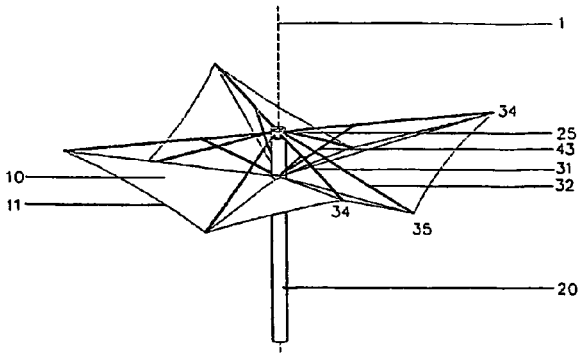
Figure 29A:
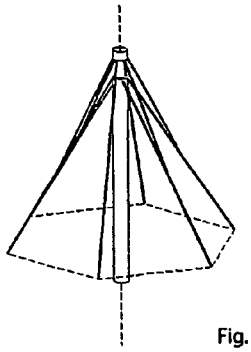
Figure 29B:
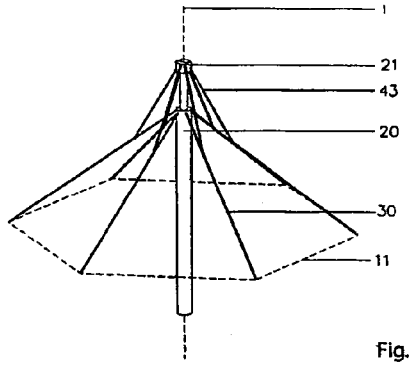
Figure 29C:
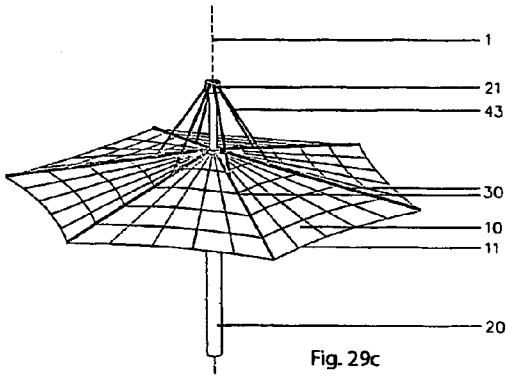
Figure 29D:
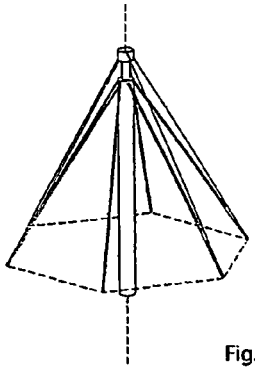
Figure 29E:
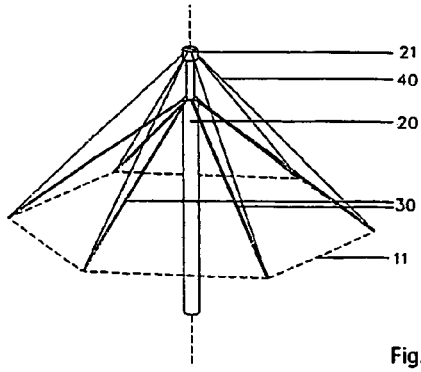
Figure 29F:
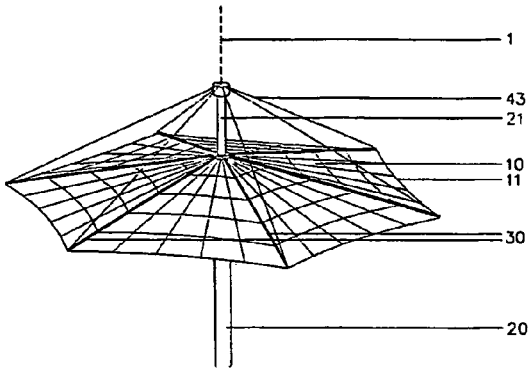
Figure 29G:
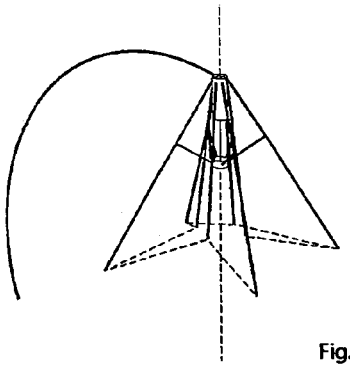
Figure 29H:
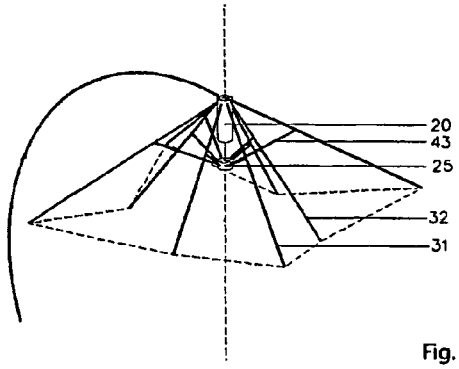
Figure 29I:
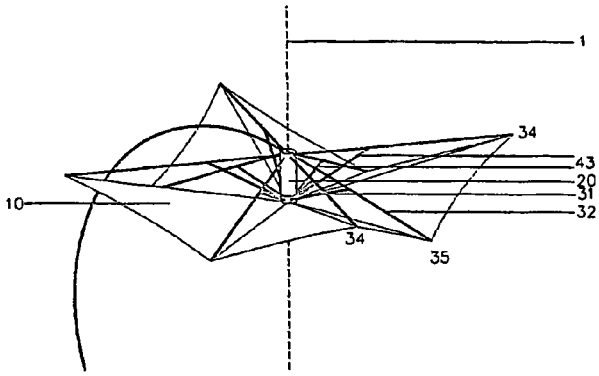

FIG. 26 shows in an isometric view an embodiment of the umbrella or its arms 30. It is clear that most of the arms 30 are tensioned downward by the static properties of the canopy 10.

FIG. 27 shows isometrically two embodiments of the umbrella or its opening and closing mechanism in different positions. In the first three views it is clear that downward movement of a runner sleeve 25 on which all of the arms 30 are pivoted opens the umbrella. In the next three views the umbrella is opened by downward movement of the shaft tip 21 on which all the arms 30 of the umbrella are pivoted. Here the lengths of the diagonal spreaders 43 do not change.

FIG. 28 shows isometrically two embodiments of the umbrella or its opening and closing mechanism in different positions. In the first three views it is clear that downward movement of a sleeve 25 on which all of the arms 30 are pivoted opens the umbrella. The lengths of the cables between the shaft 20 and the high points 34 are constant. In the following three views the umbrella is opened by downward movement of the shaft tip 21 on which all of the upper arms of the umbrella are pivoted. Here the lengths of the diagonal spreaders 43 do not change. It is clearly visible that in both embodiments the lower arms 32 are drawn upwardly by the static properties of the canopy 10.

FIG. 29 shows isometrically two embodiments of the umbrella or its opening and closing mechanism in different positions. In all views it is clear that the umbrella is opened by upward movement of the shaft tip 21 to which all the arms 30 are connected via diagonal spreaders 43 or cables 40. The lengths of the diagonal spreaders 43 of or the cables 40 between the shaft 20 and the arms 30 is constant.

Figure 30A:
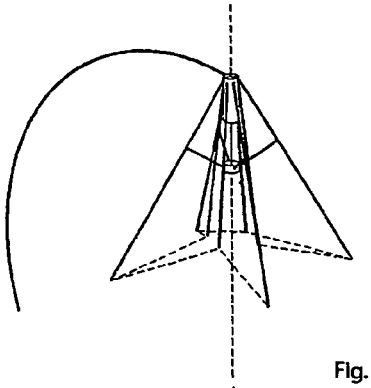
Figure 30B:
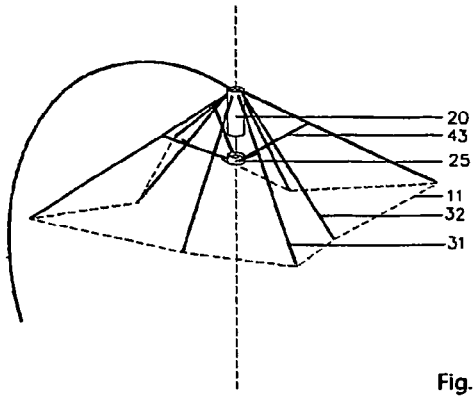
Figure 30C:
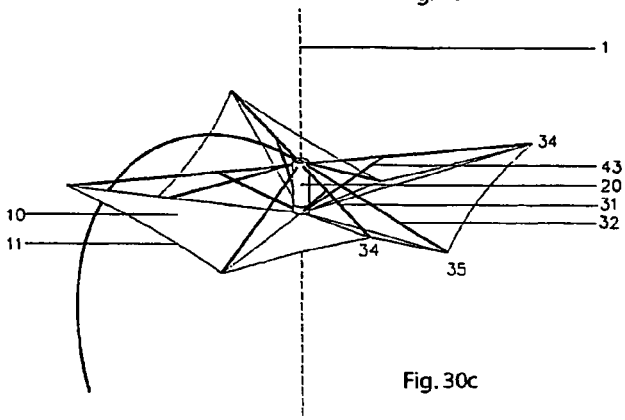

FIG. 30 shows isometrically an embodiment of the umbrella or its opening and closing mechanism in different positions. In the views it is clear that the umbrella is opened by upward movement of a sleeve 25 to which all of the upper arms 31 are connected via diagonal spreaders 43. The lengths of the diagonal spreaders 43 between the shaft 20 and the arms 30 is constant. It is clearly visible that the lower arms are drawn upward by the static properties of the canopy 10.

Figure 31A:
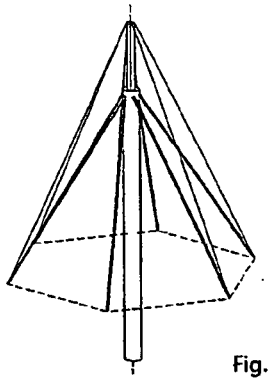
Figure 31B:
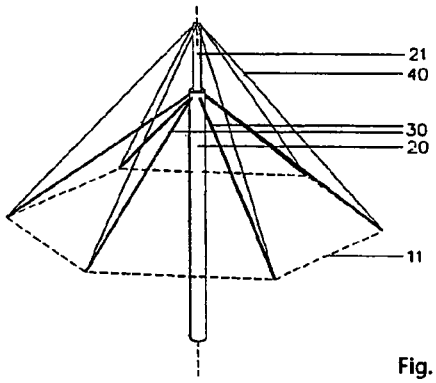
Figure 31C:
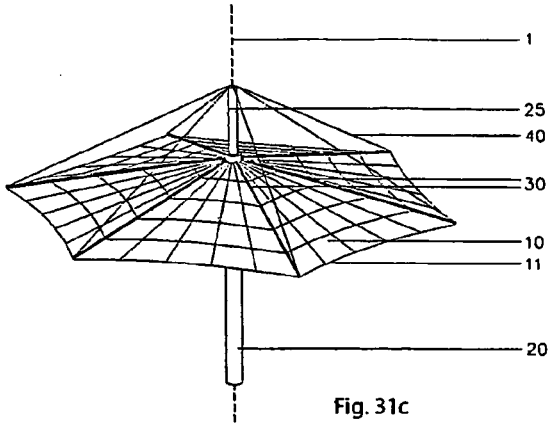

FIG. 31 shows isometrically an embodiment of the umbrella or its opening and closing mechanism in different positions. In the views it is clear that the umbrella is opened by drawing in cables 40 secured to the arms 30 of the umbrella.

Figure 32A:
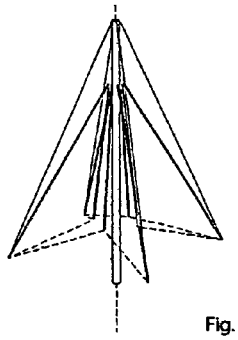
Figure 32B:
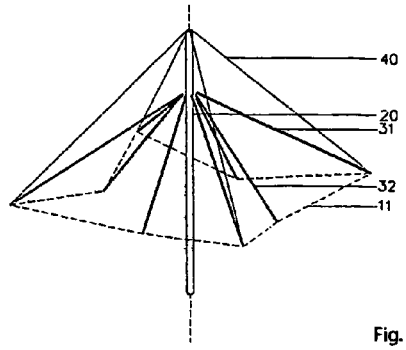
Figure 32C:
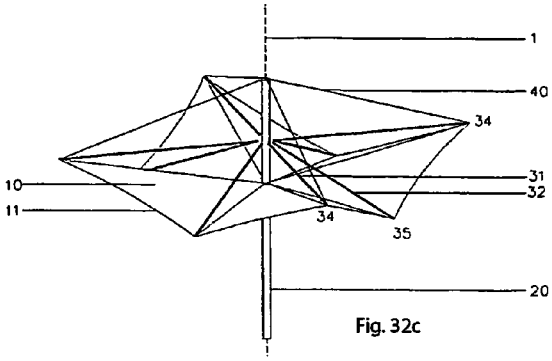

FIG. 32 shows isometrically an embodiment of the umbrella or its opening and closing mechanism in different positions. In the views it is clear that the umbrella is opened by upward movement of a sleeve 25 to which all of the upper arms 31 are connected. It is also clearly visible that the lower arms 32 are drawn upward by the static properties of the canopy 10.

Figure 33A:
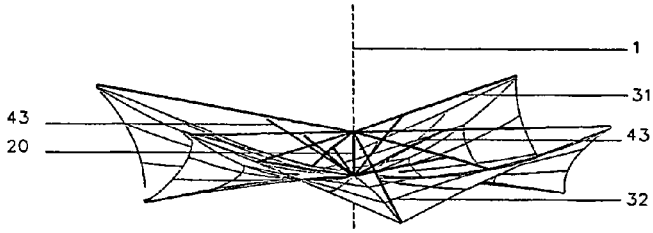
Figure 33B:
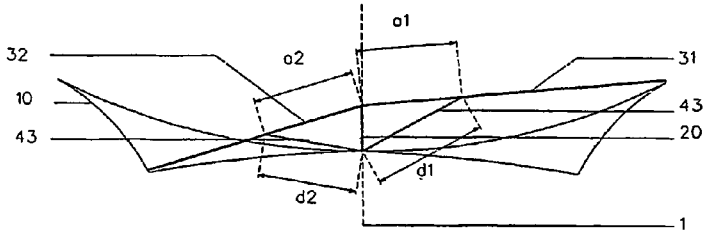

FIG. 33 shows isometrically and in section an embodiment of the umbrella or its opening and closing mechanism. It is clearly visible that the sum of the length a1 of each of the upper arms 31 from the shaft 20 to the connection with the diagonal spreaders 43 and the length d1 of the respective diagonal spreaders 43 is equal to the length a2 of each of the lower arms 32 from the shaft 20 to the connection with the diagonal spreaders 43 and the length d2 of the respective diagonal spreader 43.

Figure 34:
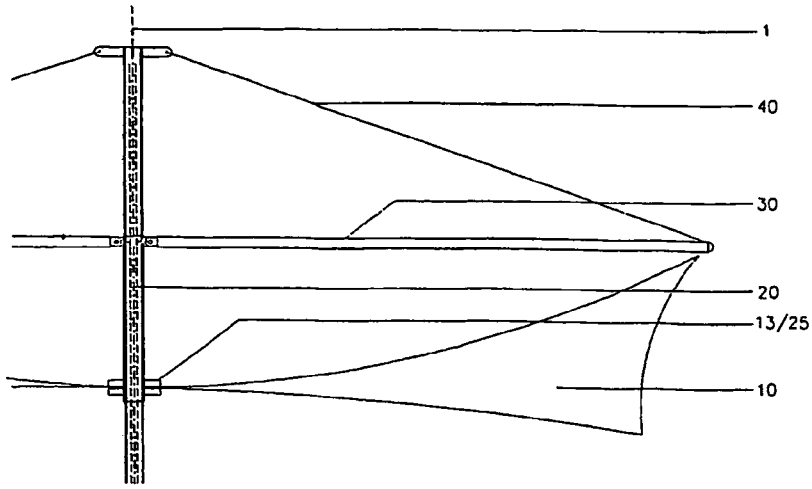

FIG. 34 shows in section an embodiment of the umbrella or its opening and closing mechanism. It is clear that the arms 30 and the canopy 10 are secured at the canopy center 13 to a common runner sleeve 25. During opening and closing of the umbrella they synchronously move along the umbrella axis 1.

Figure 35:
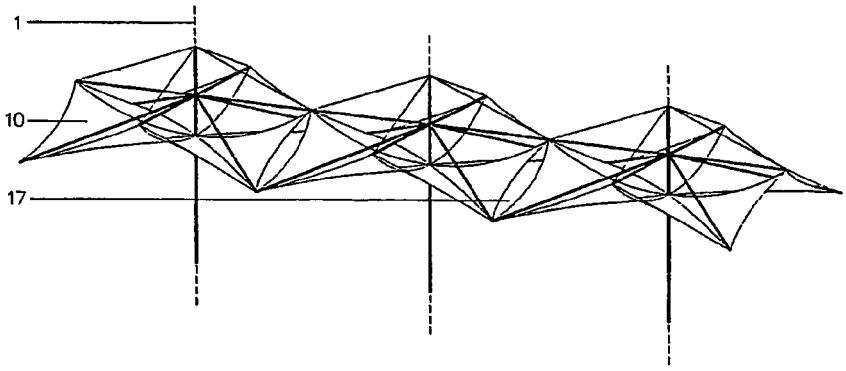
FIG. 35 is an embodiment of the umbrella in isometric view where several umbrellas are loosely joined together in a row.

FIG. 35 shows in isometric view an embodiment of the umbrella or an umbrella group. It is clear that several umbrellas can be joined together in a loosely connected row. In the illustrated embodiment the umbrellas used have high points 34 at adjacent edges so that rain water falling on them are moved outward to the high points 35.

Figure 36:
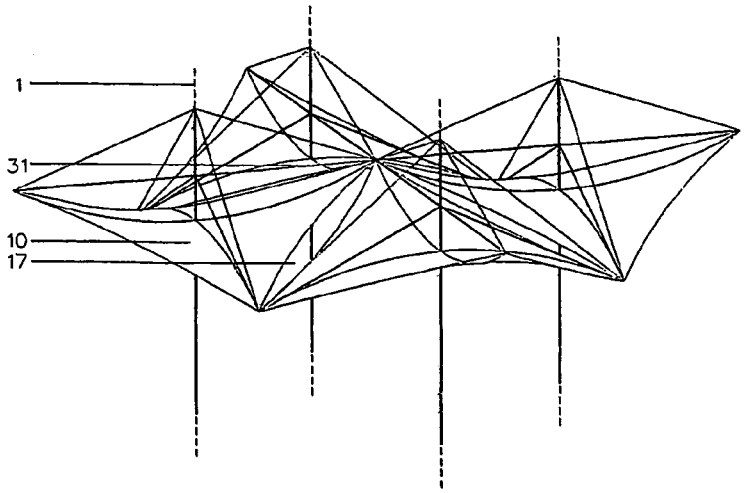
FIG. 36 is an embodiment of the umbrella in isometric view where four umbrellas are loosely joined together in a quadrilateral array.

FIG. 36 shows in isometric view an embodiment of the umbrella or an umbrella group. It is clear that at least four umbrella are joined together loosely into a quadrilateral. In the illustrated embodiment umbrellas are used that have two upper arms 31 and two lower arms 32. The umbrellas are each oriented with a upper arm 31 in the center so that dropping rain is largely deflected outward to the low points 35.

Figure 37:
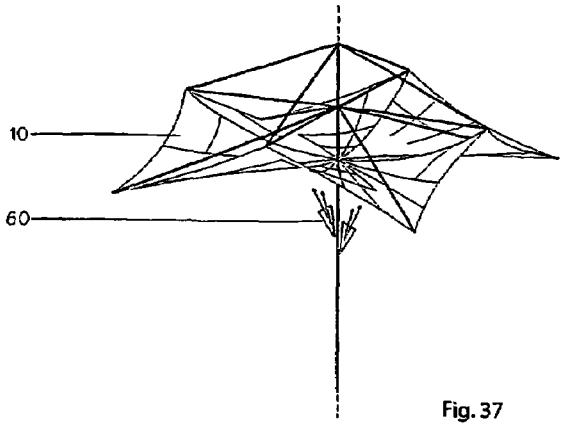
FIG. 37 shows a preferred embodiment of illumination of the umbrella in isometric view illuminated from below.
Figure 38A:
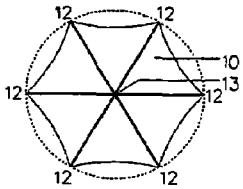
FIG. 38 is an embodiment of the umbrella in side view (a) with a circular shape, (b) with an elliptical shape, (c) with a quadrilateral shape, (d) with a rhombic shape, (e) with a rectangular shape, (f) with an eccentric umbrella axis, (g) with a semicircular shape.
Figure 38B:
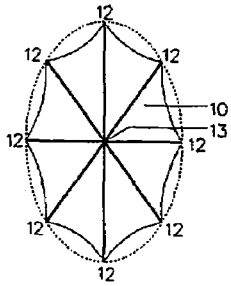
Figure 38C:
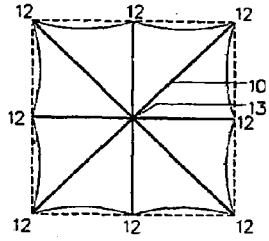
Figure 38D:
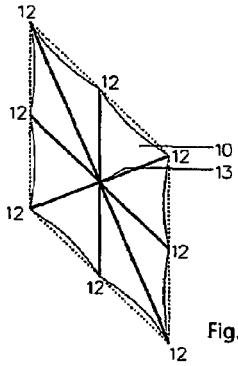
Figure 38E:
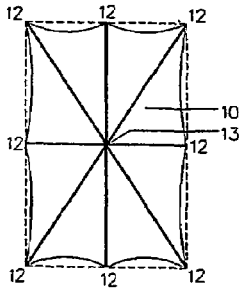
Figure 38F:
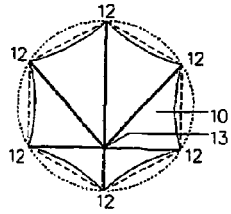
Figure 38G:
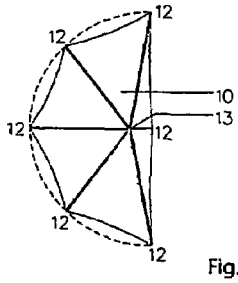

FIG. 37 shows in isometric view an embodiment of the umbrella or an umbrella group. It is clear that lamps 6 that illuminate the canopy 10 can be mounted on the shaft 20 or the support 50.

In the following FIGS. 38 to 48 the umbrella is further described with respect to selected embodiments.

FIG. 38 shows in top view embodiments of the umbrella or its canopy 10. It is clear that the canopy corners 12 define very different shapes seen from above.

Figure 39A:
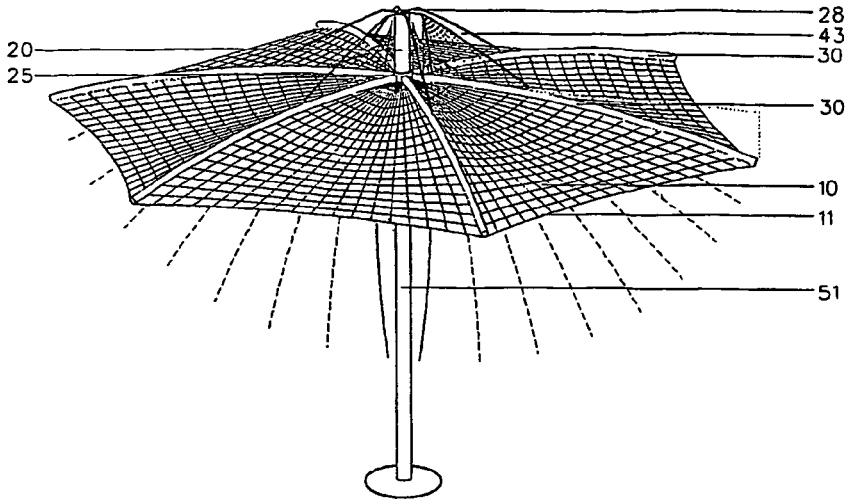
FIG. 39 is an embodiment of the umbrella in isometric view (a) and (b) with bent arms.
Figure 39B:
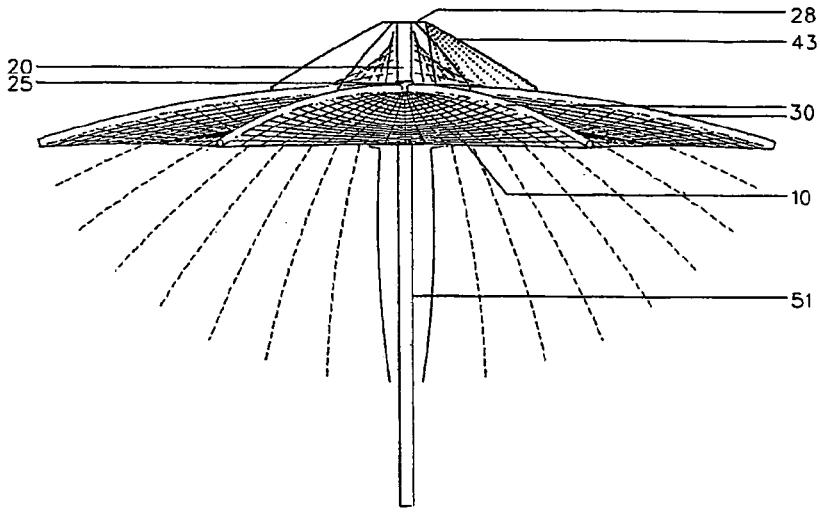

FIG. 39 shows in two isometric views the umbrella or its arms 30. It is clear that the arms 30 can be made arcuate.

Figure 40:
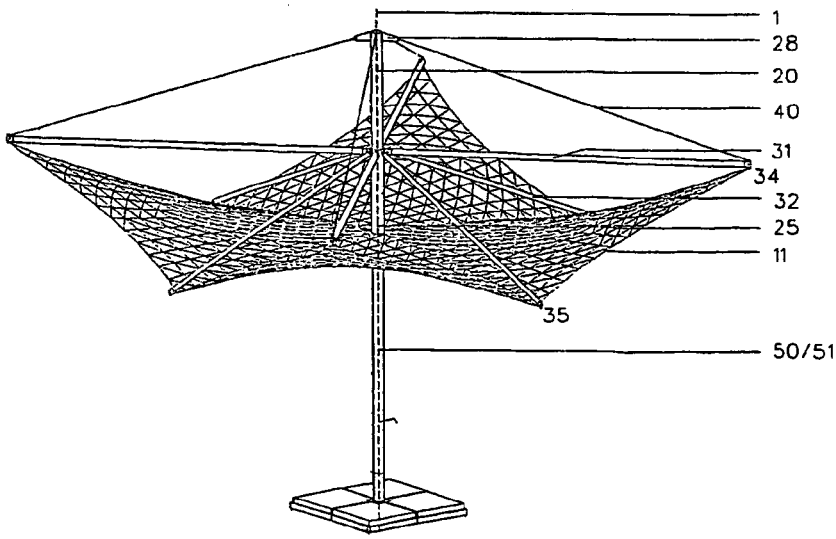
FIG. 40 is a selected embodiment of a wavy umbrella in isometric overall view carried on a mast and whose upper arms are held by cables.

FIG. 40 shows in isometric view an umbrella with a wavy canopy 10 and alternating high points 34 and low points 35 where the canopy in top view is of quadratic shape. All the upper arms 31 and lower arms 32 are pivotally supported on a runner sleeve 25 shiftable along the shaft 20. Even the canopy 10 is secured at the canopy center 13 with the lower end of this sleeve 25. The upper arms 31 are held up by cables 4 that join outer ends 33 of the upper arms 31 with a projecting mount 28 carried on the shaft tip 21. The lower arms 32 for their part are drawn upward by the canopy edge 11 that joins high points 34 and low points 35. As a result of the elasticity of the canopy 10 along the connecting line between the umbrella axis 1 and the low points 35 there is force balancing that stabilizes the umbrella. In this case sewn-on belts, integrated cables, or the like give the canopy 10 static properties and as a result of the oppositely arched shape it is particular wind resistant and stable as regards shape. The shaft 20 is in ths illustrated example formed as a mast. When the umbrella is closed the runner sleeve 25 is shifted upward on the shaft 20. This pivots the upper arms 31 and the lower arms 32 downward. The sleeve 25 is moved upward on the shaft for closing until the cables 40 connected to the mount 20 extend vertically and thus parallel to the umbrella axis 1 and form between the axes of the upper arms 31 and the cables 40 at a positive starting angle that facilitates opening of the umbrella or at least makes it possible. When opening, the sleeve 25 is moved downward so that the upper arm 31 pivot upward with their upper points 34 and the lower arms 32 are drawn upward by the canopy edge 11 and or the edge cables 24 until the pull between the umbrella axis 1 and the low points 35 starts. It is particular notable that closing of the umbrella functions also on raising of the sleeve 25 even with a table underneath it because the sleeve 25 also moves the arms 30 upward. On opening it is again moved downward and ensures as a result of the small spacing from the ground good sun protection. In addition it should be noted that, on closing, the sleeve 25 also draws the canopy 10 at it center 13 upward so that the umbrella in closed condition has no little folds.

Figure 41:
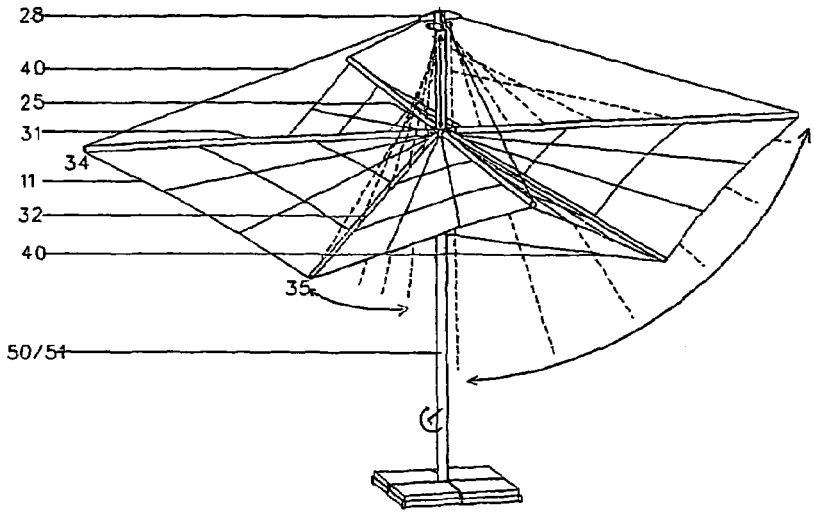
FIG. 41 is a selected embodiment of a wavy folded umbrella in isometric overall view carried on a mast and whose upper arms are held by cables with the opening positions shown.

FIG. 41 shows in isometric view an umbrella with an alternately upward and downwardly folded canopy 10. It is clear that the lower arms 32 are tensioned downward by cables 40 to the shaft 20.

Figure 42:
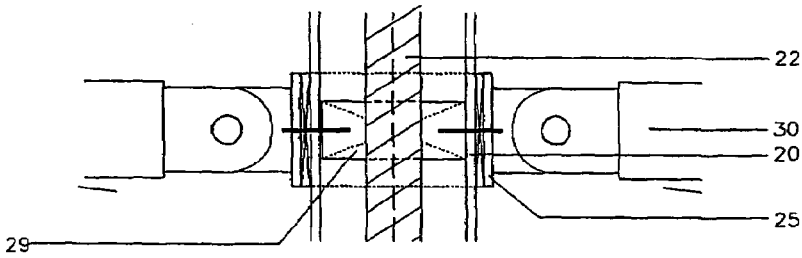
FIG. 42 is an embodiment of the rod of the umbrella in section.

FIG. 42 shows a section through an embodiment of the umbrella or its shaft 20. It is clear that inside the shaft 20 there is a threaded spindle 22 carrying a nut 29. Pins extending through vertical slits in the shaft 20 connect the nut 29 with the sleeve 25 that can be moved to open the umbrella.

Figure 43:
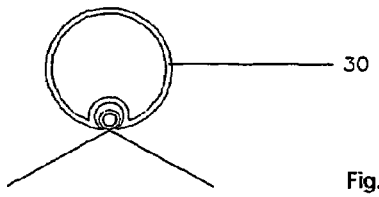
FIG. 43 is an embodiment of an arm of the umbrella in section.

FIG. 43 shows a section through an embodiment of the umbrella or its arm 30. It is clear that the arm 30 is formed with a groove in which the canopy 10 is guided.

REFERENCE LIST

1 umbrella axis
10 canopy
11 canopy edge
12 canopy corner
13 canopy center
14 canopy edge cable
15 canopy edge bar
16 canopy edge curve
17 canopy intermediate part
20 shaft
21 shaft tip
22 threaded spindle
23 crank
24 bevel-gear drive
25 sleeve
28 mount
29 nut
30 arm
31 upper arm
32 lower arm
33 outer end
34 high point
35 low point
40 cable
43 diagonal spreader
46 tensioning element
50 support
51 anchor
52 hanger
60 lamp For the sake of completeness, all the references used in the drawing are described:

The umbrella axis 1 is the imaginary geometric axis of the umbrella or its shaft 20. Most embodiments are rotation symmetrical to this axis 1.

The canopy 10 is the flexible surface that is tensioned directly or indirectly by the arms 30. It is made for example of a foil, a textile or another membrane and serves for example for protection from sun and/or rain and/or as a reflection surface.

The canopy edge 11 delimits the canopy 10 at its outer periphery. The canopy edge 11 can be reinforced by standard static procedures.

The canopy corners 12 are points at which the canopy edge 11 is drawn outward by the arms 30 of the umbrella.

The canopy center 13 is the imaginary geometric intersection of the umbrella axis 1 with the canopy 10.

The canopy-edge cable 14 is a tensioned cable that lies outside the canopy 10, extending between adjacent outer ends 33 of the arms 30 of the umbrella and uniting the canopy edge 11 statically.

The canopy-edge rods 15 are rods connected together as links or a closed chain that are joined at their ends, the joints, at arms 30 and that tension the canopy.

The canopy-edge bow 16 is an advantageously elastic annularly closed rod that is fixed at points to the arms 30 and that tensions the canopy 10.

The canopy intermediate parts 17 are small canopies 10 that are used to close gaps between adjacent umbrellas.

The shaft 20 is that portion of the mast on which the static elements necessary for opening the umbrella are mounted directly or indirectly and can be fixed or movable. Those parts of the mast do not constitute the shaft that carry the shaft 20. They are referred to as a support 50, anchor 51, or hanger 52. The shaft 30 and anchor 51 can be made of a continuous round tube, that together form the "mast."

The shaft tip 21 is the upper or lower free end of the shaft 20. The shaft tip 21 can, if necessary for the opening and closing mechanism, telescope on the shaft 20.

The threaded spindle 22 is a threaded rod that is inside the shaft 20, and preferably operated through a bevel-gear drive 24 by a crank 23 and moving the parts, as for example the shaft tip 21 or the sleeve 25 for opening and closing the umbrella.

The bevel-gear drive 24 is actuated by a crank 23 and when turned moves the threaded spindle 22 for shifting the parts necessary for opening and closing the umbrella. The bevel-gear drive 24 is preferably mounted inside the shaft 20.

The runner sleeve 25 is a movable mechanical part on the shaft 20 to which the arms 30, cables 40 or diagonal spreaders 43 are connected. Moving the sleeve 25 opens and closes the umbrella. The sleeve 25 can, unlike in normal parlance, be a part movable along the umbrella axis 1 to which the diagonal spreaders 43 are connected and that does not require have a hole at the umbrella axis 1 since it does not surround a shaft 20 ending above and is only connected with it via a tension cable.

The mount 28 is a spacer mounted directly or indirectly fixedly or movably on the shaft 20 to which the arms 30, the cables 40, or the diagonal spreaders 43 are connected so that when the umbrella is closed there is a small acute angle between the arms 30 and the cables 40 or the diagonal struts 43 so as to facilitate opening of the umbrella.

The threaded nut 29 is the mechanical part inside the shaft 20 that is shifted upward and downward along the axis 1 by the threaded spindle 22. The nut 29 for example moves the sleeve 25 or the shaft tip 21.

The arms 30 are pivotally mounted rods extending radially from the axis 1 and directly or indirectly tensioning the canopy 10. The arms 30 are held in position by the cables 40, diagonal spreaders 43, and/or the tension of the canopy 10 in their position tensioning the canopy 10. According to the embodiment, the arms 30 are bent when tensioned or if necessary are made arcuate.

The upper arms 31 are those arms 30 that draw the canopy 10 upward directly or indirectly. According to embodiment, the upper arms 31 are differently inclined from the umbrella axis 1.

The lower arms 32 are those arms 30 that draw the canopy 10 downward directly or indirectly. The lower arms are always differently inclined downward from the axis 1.

The outer ends 33 are the actual outer ends turned away from the axis 1 of the arms 30. The outer ends 33 are usually connected to the canopy corners 12.

The high points 34 are the outer actual ends turned away from the axis 1 of the upper arms 31. They also refer to the outer joints between adjacent canopy edge rods 15.

The low points 35 are the outer actual ends turned away from the axis 1 of the lower arms 32. They also refer to the outer joints between adjacent canopy edge rods 15.

The cables 40 are tensioned cables that join the outer ends 33 with the shaft 20 or the mount 28.

The diagonal spreaders 43 are push-type rods and/or tension cables that connect points along the arms 30 with the shaft 20 or with the mount 28.

The tensioning elements 46 are fittings that engage between the canopy corners 12 and the outer ends 33 of the arms 30. The tensioning elements are in particular used in umbrella groups in order to install a canopy 10 after the arms 30 have been unfolded to form a throughgoing canopy 10.

The support 50 is the static part that holds the shaft 20, that is that connects the lower end of the shaft 20 to the floor or that engages the shaft 20 from above and allows the umbrella to be mounted on a wall or structure extending up from the floor.

The anchor 51 is a static part that holds the shaft 20 and connects it to the floor. The simplest embodiment of an anchor 51 is a mast.

The hanger 52 is a part that engages over the shaft from above.

The lamp 60 is an emitter or projector that illuminates the canopy 10. The lamp 60 can illuminate or project advertising on the umbrella.

The invention claimed is:

1. An umbrella comprising:

a shaft anchorable in or on the ground or in the air by an anchor and defining an axis, a canopy movable between an unfolded open position in which it is wavy and a folded position inclined to the axis, made of a preferably nonstretching membrane or fabric, formed of a whole number of polygonal sections with outer corners defining alternating high points and low points, traversed at a center by the shaft, centrally axially slidable along the shaft or centrally fixed on the shaft, and having an outer edge, and an array of rods extending radially from and pivoted on the shaft and extending in the open unfolded position from the shaft to the corners, the rods being wholly above the canopy and not passing through the canopy.

2. The umbrella according to claim 1 wherein the canopy has an even number 2n of high points and low points so it has n high points and n low points that alternate at the edge of the canopy in the open position and that impart to the canopy a wavy shape, the high points tensioning the canopy up and out and the low points tensioning the canopy down and out.

3. The umbrella according to claim 1 wherein the canopy has a predetermined number n of low points, the canopy being drawn up to and geometrically intersecting the umbrella axis at a center so as to set a conical shape in the canopy.

4. The umbrella according to claim 1 wherein the canopy has a predetermined number n of edge rods, the edge rods being secured at spaced locations or along their entire length with the respective canopy edge and being alternately inclined to impart a wavy shape to the canopy.

5. The umbrella according to claim 1 wherein the canopy is tensioned by a preferably elastic annularly closed canopy-edge bow, the edge bow being secured at spaced locations or along its entire length with the canopy edge and being oppositely inclined to impart a wavy shape to the canopy.

6. The umbrella according to claim 1 wherein the canopy is secured at the center to the shaft or to a runner sleeve slidable on the shaft.

7. The umbrella according to claim 6 wherein, when the canopy is attached to the runner sleeve, in the open position the center of the canopy is shiftable along the shaft, the canopy being sealed at the center to the shaft by the runner sleeve.

8. The umbrella according to claim 1 wherein the canopy is so cut out or constructed at the center that it lightly touches or freely surrounds the shaft and is shiftable at the center along the shaft.

9. The umbrella according to claim 1 wherein the rods include upper rods and lower rods and in the open position of the umbrella, longitudinal axes of the upper rods intersect the umbrella axis at an upper common point and longitudinal axes of the lower rods intersect the umbrella axis at a lower common point below the upper common point.

10. The umbrella according to claim 1 wherein in the open position of the umbrella some or all of the rods are tensioned upward into positions necessary for the open position by respective cables extending between outer ends and the shaft.

11. The umbrella according to claim 1 wherein in the open position of the umbrella some or all of the rods are tensioned upward into positions necessary for the open position by diagonal spreaders that extend under tension or compression and are preferably pivoted between the rods and the shaft.

12. The umbrella according to claim 1 wherein in the open position of the umbrella some or all of the rods are tensioned downward into positions necessary for the open position by diagonal spreaders that extend under tension or compression and are pivoted between the rods and the shaft.

13. The umbrella according to claim 1 wherein the umbrella is opened by an opening and closing mechanism having a sleeve or shiftable telescoping shaft tip on which all the rods are pivoted, and that can move downward along the umbrella axis so that all the rods and the canopy mounted on these rods are pushed or pulled by cables and/or diagonal spreaders into positions necessary for the open position until the canopy is fully tensioned and the entire system assumes a stable position as a result of limits established by the static properties and geometry of the canopy, the canopy edge, the edge rods, the edge bow, or the edge cables or by the cables or diagonal spreaders.

14. The umbrella according to claim 1 wherein the sum of the lengths a of the rods measured from the shaft where they engage the respective diagonal spreaders and the lengths d of the diagonal spreaders is the same for all arms, where a+d=constant so that in particular umbrellas with upper rods and lower rods can be completely folded together.

15. The umbrella according to claim 1 wherein the umbrella is closed by an opening and closing mechanism where all the rods and the canopy are secured at the center to a common sleeve so that lifting of the sleeve raises the center and the canopy assumes a closed position folded together at the center.

16. An openable and closable umbrella for protection against sun and rain, the umbrella comprising:

a shaft anchorable in or on the ground or in the air by an anchor and defining an upright axis;

a canopy movable between an open unfolded position in which it is wavy and a folded closed condition inclined to the axis, made of a preferably nonstretching membrane or fabric, formed of a whole number of polygonal sections with corners defining alternating high points and low points, centrally traversed by the shaft, centrally axially slidable along or fixed on the shaft, and having an outer edge, the canopy being oriented such that in the open position water falling on it flows to the outer edge, the canopy forming between two adjacent sections an open gap;

a cable extending from corner to corner across the gap; and an array of rods extending radially from and pivoted on the shaft and extending in the open position from the shaft to the corners of the sections, the rods being wholly above the canopy and not passing through the canopy.

17. An openable and closable umbrella for protection against sun and rain, the umbrella comprising:

a shaft supported from above and defining an upright axis;

a canopy movable between an open unfolded position in which it is wavy and a folded closed condition inclined to the axis, having a closed center below a lower end of the shaft, made of a preferably nonstretching membrane or fabric, formed of a whole number of polygonal sections with corners defining alternating high points and low points, centrally traversed by the shaft, centrally axially slidable along or fixed on the shaft, and having an outer edge, the canopy being oriented such that in the open position water falling on it flows to the outer edge; and an array of rods extending radially from and pivoted on the shaft and extending in the open position from the shaft to the corners of the sections, the rods being wholly above the canopy and not passing through the canopy.

* * * * *